United States Patent [19]

Hirano et al.

[11] Patent Number: 4,931,378

[45] Date of Patent: Jun. 5, 1990

[54] METHOD OF PROCESSING SILVER HALIDE PHOTOGRAPHIC MATERIALS WHERE THE ROLLERS ARE INTERMITTENTLY ROTATED DURING STAND-BY

[75] Inventors: Masato Hirano; Eiichi Tadokoro, both of Kanagawa, Japan

[73] Assignee: Fuji Photo Film Co., Ltd., Kanagawa, Japan

[21] Appl. No.: 279,897

[22] Filed: Dec. 5, 1988

[30] Foreign Application Priority Data

Dec. 3, 1987 [JP] Japan ..... 62-306292

[51] Int. Cl.[5] ..... G03C 5/24; G03C 7/16

[52] U.S. Cl. ..... 430/264; 430/378; 430/406; 430/409; 430/434; 430/438; 430/464; 354/320; 354/321

[58] Field of Search ..... 354/320, 321, 322; 430/409, 264, 410, 438, 434, 464, 378, 406

[56] References Cited

U.S. PATENT DOCUMENTS

| | | | |
|---|---|---|---|
| 4,099,194 | 7/1978 | Kümmerl | 354/321 |
| 4,327,456 | 5/1982 | Deconinck | 354/321 |
| 4,789,627 | 12/1988 | Inoue et al. | 430/405 |
| 4,863,839 | 9/1989 | Heki et al. | 430/378 |

FOREIGN PATENT DOCUMENTS

| | | | |
|---|---|---|---|
| 1154459 | 6/1969 | United Kingdom | 354/321 |

*Primary Examiner*—Roland E. Martin
*Assistant Examiner*—Patrick Doody
*Attorney, Agent, or Firm*—Sughrue, Mion, Zinn, Macpeak & Seas

[57] ABSTRACT

Disclosed is a method for processing a silver halide photographic material having at least one silver halide emulsion layer on a support and containing at least one hydrazine derivative in said silver halide emulsion layer or in another hydrophilic colloid layer with a roller-conveying type automatic developing machine using a dihydroxybenzene developer containing a sulfite preservative in an amount of 0.15 mol/liter or more at pH of 10.5 to 12.3, which method is characterized in that at least the roller which is in contact with both the developer and air, among the rollers of the said developing machine, is continuously rotated at a determined speed during conveyance or processing of the material during a processing phase, and intermittently rotated during a stand-by phase. By the method, the photographic material may be processed stably and rapidly for a long period of time to give an image having a high contrast and a high blackened density. The method requires only a small amount of replenisher to compensate for the processing solution fatigued after repeated use.

7 Claims, 1 Drawing Sheet

METHOD OF PROCESSING SILVER HALIDE PHOTOGRAPHIC MATERIALS WHERE THE ROLLERS ARE INTERMITTENTLY ROTATED DURING STAND-BY

FIELD OF THE INVENTION

The present invention relates to a method for developing a silver halide photographic material with high contrast and, in particular, to a method of forming a high contrast negative image which is suitable for use in a photomechanical printing process for graphic arts.

BACKGROUND OF THE INVENTION

In the field of graphic arts, a system of forming an image with high contrast photographic characteristics is required so as to improve the reproduction of an image with continuous gradation by dot images or the faithful reproduction of a line image.

Hithereto, a particular developer which is called a lith developer has been used for the purpose. The ligh developer contains only hydroquinone as a developing agent and contains only hydroquinone as a developing agent and contains a preservative in the form of a sulfite/formaldehyde adduct so that the concentration of the free sulfite ion in the developer is made extremely low so as not to interfere with the infectious developability of the developer. Accordingly, the lith developer has a serious defect that it is extremely easily oxidized with air and cannot be preserved for a long period of time, i.e., more than 3 days.

Under the circumstances, noticeable efforts have been made so as to obtain effective means of stably maintaining the activity of the developer. Various alternative photographic systems capable of overcoming said problems and forming images with high contrast photographic characteristics have been proposed.

As a means of forming an image with high contrast photographic characteristics by the use of a stable developer, for example, there are the methods of using a hydrazine derivative as described in U.S. Pat. Nos. 4,224,401, 4,168,977, 4,166,742, 4,311,781, 4,272,606, 4,211,857 and 4,243,739.

In accordance with said methods, a silver halide photographic material containing a particular hydrazine derivative is processed with a developer containing a sulfite preservative in an amount of 0.15 mol/liter or more, at pH 10.5 to 12.3, and the photographic material has a high sensitivity and may form an image with high contrast photographic characteristics. Further, as the developer may contain a sulfite of a high concentration, the stability of the developer against aerial oxidation is far higher than that of a ligh developer. In addition, the development time may noticeably be reduced.

In general, an automatic developing machine is used for processing the high contrast silver halide photographic materials of this kind. As automatic developing devices for black-and-white silver halide photographic materials, heretofore a suspended automatic developing machine, a processing machine for motion picture film, a roller-conveying automatic developig machine, a rotary automatic developing machine for disc film, a rotary drum automatic developing machine and a reel-combined automatic developing machine have been put to practical use. These automatic developing machines are equipped with tanks for housing a developer, a fixer, a stabilizer, a bleaching solution and optionally a stopping solution, an adjusting solution and a reversing solution. Ideally, it is desired to protect these solutions, except the bleaching solution, from oxidizing and aging due to contact with air. However, as the respective surface area of the respective processing solutions to be contacted with air is large. Accordingly, there is a problem of noticeable deterioration and evaporation of processing solutions because of aerial oxidation. In particular, in the field of photomechanical processes where typical black-and-white silver halide photographic material sheets are mostly used, a roller-conveying type automatic developing machine having a large open area ratio (K) is mainly used because of the easy operatability, rapid processability and simple processability. The open area ratio (K) $cm^{-1}$ as referred to herein means a value of the air contact surface of processing solution (S) $cm^2$ as divided by the volume of the solution (V) $cm^3$ and is represented by the following equation:

$$K=S/V(cm^{-1})$$

The structure of the roller-conveying type automatic developing machine is as shown in FIG. 1, where the taking-in conveyors rollers and/or the taking-out conveyor rollers are kept in contact with both the developer and air. More precisely, FIG. 1 (*a*) shows one embodiment where all the nip rollers (5) and (6) in the taking-out side and the nip rollers (3) and (4) in the introduction side are partly dipped in the processing solution; and FIG. 1 (*b*) and FIG. 1 (*c*) shows other embodiments where the nip roller (6) in the exciting side is partly dipped in the processing solution. Such structure is required so as to accelerate the conveyance time and to prevent the dot image from being disordered and the line image from being cut.

In the roller-conveying type automatic developing machine of said system, the open area ratio (K) is required to be investigated in two cases. Precisely, the open area ratio ($K_S$) while the rollers are not moved (or static) is represented by the following equiation (1) in consideration of only the horizontal liquid area ($S_1$) which is directly contacted with air.

$$K_s=S_1/V \quad (1)$$

On the other hand, the open area ratio ($K_D$) while the rollers are being moved (or dynamic) is represented by the following equation (2). since the surface area of the liquid ($S_2$) which is on the surface of the rollers above the liquid surface is to be taken into consideration together with the horizontal liquid area ($S_1$).

$$K_D=(S_1+S_2)/V \quad (2)$$

In the roller-conveying type automatic developing machines which have heretofore been put to practical use, $K_S$ is from 0.03 to 0.15, $K_D$ is from 0.05 to 0.20, and $K_D/K_S$ is from 1.2 to 5. In general, the rollers are not rotated when no development is carried out, so that the liquid on the surface of the rollers evaporates, and the residues form deposits on the rollers.

An ultra-hard processing system in which a silver halide photographic material containing at least one hydrazine derivative is processed with a dihydroxybenzene developer containing a sulfite preservative in an amount of 0.15 mol/liter or more at pH 10.5 to 12.3 is a system having greatly more improved stability and rapid processability than a conventional lith development system. However, when the system is carried out by the use of a roller-conveying type automatic developing machine with a high open area ratio, there are still various problems as mentioned below.

(a) As the processing solution has a high pH value, the solution is easily oxidized with air in a roller-conveying type automatic developing machine with a high open area ratio so that the developing agent and the preservative used are rapidly deteriorated.

(b) The processing solution easily absorbs carbon dioxide from the air and thus the development activity of the solution often varies in accordance with the variation of the $CO_2$ concentration in the surrounding atmosphere. In particular, under winter like circumstances where gas, petroleum and stoves are much used, the pH value of the developer would drop so that the variation of the photographic characteristics would become noticeable in some photographic materials.

(c) Water is readily evaporated and the solution is easily concentrated. The photographic characteristics of the processed photographic materials would vary because of the variation of the concentration of the processing solution.

(d) In order to compensate for the variation of the concentration of the processing solution, a large amount of replenisher is required.

Because of evaporation of solvent and concentration of chemicals in the processing solution, the liquid level is lowered, the solids content dries and forms deposits which would adhere to rollers and gears and would cause stains or development blurs as well as mechanical accidents in the developing machine.

In order to overcome said problems, provisions of a floating lid ((7) in FIG. 1 (*b*) or 1 (*c*)) to cover the complete surface of the processing solution has been proposed, with the floating lid being removed during development, or provision of floating lids on the surface parts of the processing solution except at the surface where the photographic material passes through and where the photographic material-conveying device part in the tank communicates with the surface has also been proposed. In the former case, however, it is extremely troublesome and complicated to arrange and remove the floating lid in the automatic developing machine. In the latter case, the area of the surface of the processing solution to be covered by the floating lids is small, since the solution tank is equipped with rollers, and therefore, the effect of preventing aerial oxidation by the floating lids would be substantially small. For these reasons, neither of the two approaches could be said to satisfactorily overcome the problems. In addition, when the floating lids were arranged on the surface of the processing solution, these would rotate on the liquid surface during running of the developing machine, and therefore, a bad influence of substantially increasing the surface area of the processing solution is inevitable because of the provision of the lids.

On the other hand, there is another method in which the surface of the developer in an automatic developing machine is covered except at the inlet and outlet parts for the photographic material to be processed so that the area of the solution to be contacted with water may be reduced. However, the method is often accompanied by problems on the operability of the developing machine.

SUMMARY OF THE INVENTION

The object of the present invention is to overcome the above-mentioned problems in the prior art and to provide a method for processing a silver halide photographic material stably and rapidly for a long period of time to give an image having a high contrast and a high blackened density, which requires only a small amount of a replenisher for compensating the processing solution fatigued after repeated used.

This object may be attained by a method of processing a silver halide photographic material having at least one silver halide emulsion layer on a support and containing at least one hydrazine derivative in the silver halide emulsion layer or in another hydrophilic colloid layer with a roller-conveying type automatic developing machine using a dihydroxybenzene developer containing a sulfite preservative in an amount of 0.15 mol/liter or more at a pH of 10.5 to 12.3, wherein any roller which is in contact with both the developer and air is continuously rotated at a determined speed during conveyance or processing of the material during a processing phase, and intermittently rotated during a stand-by phase.

DETAILED DESCRIPTION OF THE INVENTION

Figure 1A:
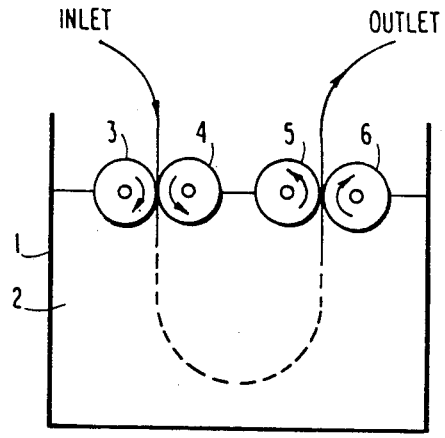
FIGS. 1 (*a*), (*b*) and (*c*) are each a sectional view to show an outline of a developer tank of an automatic developing machine for use in the present invention.

As one preferred embodiment of the present invention, the proportion of the time for rotating the roller which is at least in contact with both the developer and air at the stand-by phase to the total stand-by time is desired to be from ½ to 1/20. One period for rotating the roller is preferably more than the time required for one rotation of the roller.

Because of the constitution of the rollers in the developer tank, the deterioration of the developer by aerial oxidation at the stand-by phase may be reduced more than the case where said rollers are continuously rotated. In addition, as compared with the case where the rollers are kept stopped, the method of the present invention is more advantageous as no developer components are deposited and adhered on the surface of the rollers.

In accordance with the present invention, it is necessary only that the rollers which are in contact with both the developer in the development tank and air satisfy the defined condition as above to prevent depletion or oxidation of the developer but the other conveying rollers (for example, conveying rollers in developer tank, fixer tank, rinsing tank and other conveying rollers outside the processing tanks) are also preferably rotated to satisfy the above defined condition to thereby prevent formation of deposits, etc.

The effect of the present invention is extremely noticeable when the present invention is applied to an automatic developing machine having a developer tank with an open area ratio ($K_S$) of from 0.03 to 0.15, an open area ratio ($K_D$) of from 0.05 to 0.20 and a ratio of $K_D/K_S$ of from 1.2 to 5.

The control of rotation and stopping of the rollers may be effected by an automatic controlling device with a microcomputer or a mechanical controlling device with a timer circuit.

The hydrazine derivatives for use in the photographic materials processed in accordance with the method of the present invention are preferably those represented by the following formula (I):

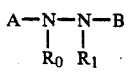

(I)

in which A represents an aliphatic group or an aromatic group;

B represents a formyl group, an acyl group, an alkyl- or arylsulfonyl group, an alkyl- or arylsulfinyl group, a carbamoyl group, an alkoxy- or aryloxycarbonyl group, a sulfinamoyl group, an alkoxysulfonyl group, a thioacyl group, a thiocarbamoyl group, a sulfanyl group or a heterocyclic group;

$R_0$ and $R_1$ are both hydrogen atoms, or one of them represents a hydrogen atom and the other represents a substituted or unsubstituted alkylsulfonyl group, a substituted or unsubstituted arylsulfonyl group, or a substituted or unsubstituted acyl group; and B and $R_1$ and the adjacent nitrogen atom to which B and $R_1$ are bonded may form a partial structure

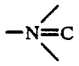

of a hydrazone.

Next, the compounds of the formula (I) will be explained in detail hereunder.

In the formula (I), the aliphatic group for A preferably has from 1 to 30 carbon atoms and is especially preferably a linear, branched or cyclic alkyl group havng from 1 to 20 carbon atoms. The branched alkyl group may be cyclized to form a saturated heteroring containing one or more hetero atoms in the ring. The alkyl group may have one or more substituents selected from an aryl group, an alkoxy group, a sulfoxy group, a sulfonamide group, and a carbonamide group.

For example, there may be mentioned t-butyl, n-octyl, t-octyl, cyclohexyl, pyrrolidyl, imidazolyl, tetrahydrofuryl and morpholino groups as the examples of the group.

In the formula (I), the aromatic group for A is a monocyclic or bicyclic aryl group or unsaturated heterocyclic group. The unsaturated heterocyclic group may be condensed with a monocyclic or bicyclic aryl group to form a hetero-aryl group.

For example, there are benzene ring, naphthalene ring, pyridine ring, pyrimidine ring, imidazole ring, pyrazole ring, quinoline ring, isoquinoline ring, benezimidazole ring, thiazole ring and benzothiazole ring, and benzene ring-containing groups are most preferred among them.

A is especially preferably an aryl group.

The aryl group or unsaturated heterocyclic group for A may have a substituent(s). Specific examples of the substituents for the group include a linear, branched or cyclic alkyl group (preferably having from 1 to 20 carbon atoms), an aralkyl group (preferably a monocyclic or bicyclic group in which the alkyl moiety has from 1 to 3 carbon atoms), an alkoxy group (preferably having from (1 to 20 carbon atoms), a substituted amino group (preferably an amino group substituted by an alkyl group having from 1 to 20 carbon atoms), an acylamino group (preferably having from 2 to 30 carbon atoms), a sulfonamido group (preferably having from 1 to 3 30 carbon atoms), a ureido group (preferably having from 1 to 30 carbon atoms), etc.

In the formula (I), A may contain a ballast group which is generally used in passive state photographic additives such as couplers, as combined therein. The ballast group is a group which is relatively inactive to photographic properties and has 8 or more carbon atoms. For example, this may be selected from an alkyl group, an alkoxy group, a phenyl group, an alkylphenyl group, a phenoxy group, and an alkylphenoxy group.

In the formula (I), A may contain a group capable fo strengthening the adsorbability of the hydrazine derivative to the surface of silver halide grains. As examples of such adsorbing groups, there are a thiourea group, a heterocyclic thioamido group, a mercapto-heterocyclic group and a triazole group, such as those described in U.S. Pat. Nos. 4,385,108 and 4,459,347, JP-A-No. 59-195233, JP-A-No. 59-200231, JP-A-No. 59-201045, JP-A-No. 59-201046, JP-A-No. 59-201047, JP-A-No. 59-201048, JP-A-No. 59-201049, JP-A-No. 60-179734 and JP-A-No. 61-170733 (the term "JP-A" as used herein means an "unexamined published Japanese patent application").

Specifically, B represents a formyl group, an acyl group (e.g., acetyl, propionyl, trifluoroacetyl, chloroacetyl, benzoyl, 4-chlorobenzoyl, pyruvoyl, methoxalyl, methyloxamoyl), an alkylsulfonyl group (e.g., methanesulfonyl, 2-chloroethanesulfonyl), an arylsulfonyl group (e.g., benzenesulfonyl), an alkylsulfinyl group (e.g., methanesulfinyl), an arylsulfinyl group (e.g., benzenesulfinyl), a carbamoyl group (e.g., methylcarbamoyl, phenylcarbamoyl), a sulfamoyl group (e.g., dimethylsulfamoyl), an alkoxycarbonyl group (e.g., methoxycarbonyl, methoxyethoxycarbonyl), an aryloxycarbonyl group (e.g., phenoxycarbonyl), a sulfamoyl group (e.g., methylsulfamoyl), an alkoxysulfonyl group (e.g., methoxysulfonyl, ethoxysulfonyl), a thioacyl group (e.g., methylthiocarbonyl), a thiocarbamoyl group (e.g., methylthiocarbamoyl group) or a heterocyclic group (e.g., pyridine ring).

Especially preferably, B is a formyl group or an acyl group.

In the formula (I), B and $R_1$ and the adjacent nitrogen atom to which B and $R_1$ are bonded may form a partial structure of a hydrazone of

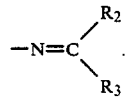

In said formula, $R_2$ represents an alkyl group, an aryl group or a heterocyclic group; and $R_3$ represents a hydrogen atom, an alkyl group, an aryl group or a heterocyclic group.

In the formula (I), $R_0$ and $R_1$ each represents a hydrogen atom, an alkylsulfonyl or arylsulfonyl group having 20 or less carbon atoms (preferably an unsubstituted phenylsulfonyl group or a phenylsulfonyl group substituted so that the total of the Hammett's substituent constants may be −0.5 or more) or an acyl group having 20 or less carbon atoms (preferably an unsubstituted benzoyl group, a benzoyl group substituted so that the total of the Hammett's substituent constants may be −0.5 or more, or a linear, branched or cyclic unsubstituted or substituted aliphatic acyl group, the substituent for the acyl group being selected from a halogen atom, an ether group, a sulfonamido group, a carbonamido group, a hydroxyl group, a carbonxyl group and a sulfonic acid group).

$R_0$ and $R_1$ are most preferably hydrogen atoms.

As the hydrazine derivatives for use in the present invention, there are the compounds described in *Research Disclosure*, Item 23516 (Nov., 1983, page 346) and publications as referred to therein as well as the compounds described in U.S. Pat. Nos. 4,080,207, 4,269,929, 4,276,364, 4,278,748, 4,385,108, 4,459,347, 4,560,638 and 4,478,928, British Patent No. 2,011,391B and JP-A-No. 60-179734, in addition to the compounds mentioned hereinabove.

Examples of the compounds of the formula (I) are mentioned below.

(I-1)

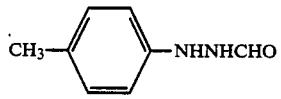

(I-2)

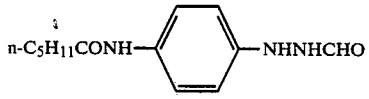

(I-3)

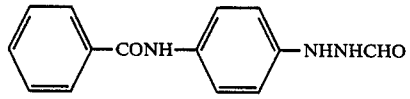

(I-4)

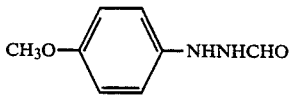

(I-5)

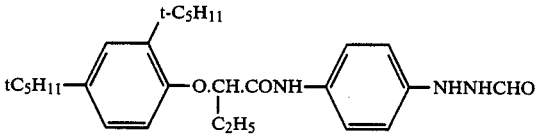

(I-6)

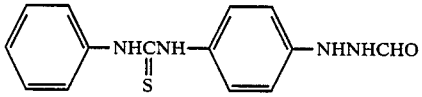

(I-7)

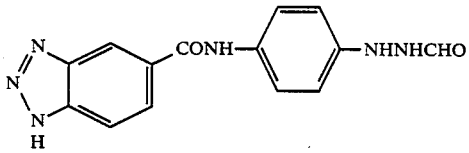

(I-8)

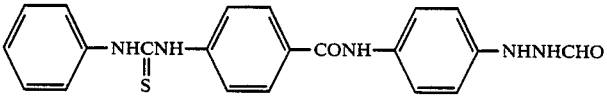

(I-9)

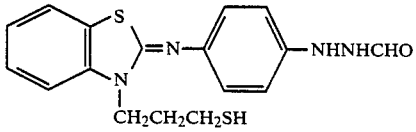

(I-10)

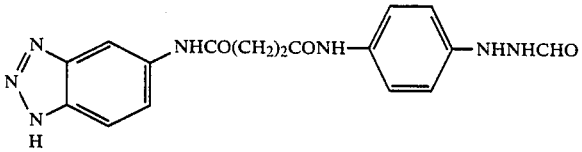

-continued
(I-11)
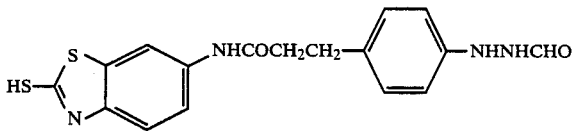
(I-12)
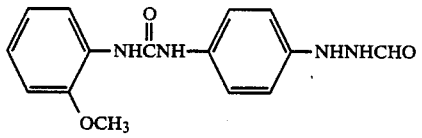
(I-13)
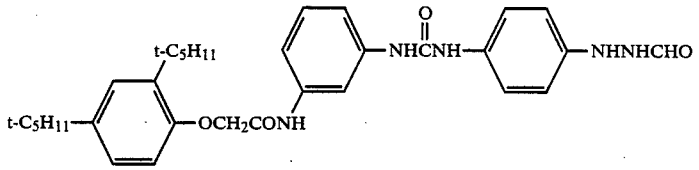
(I-14)
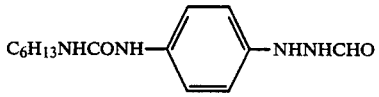
(I-15)
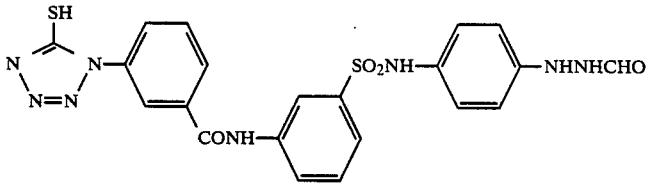
(I-16)
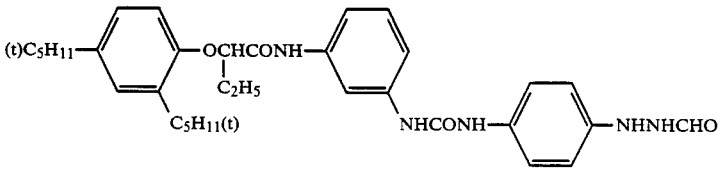
(I-17)
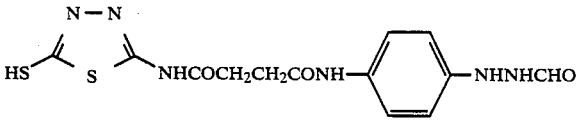
(I-18)
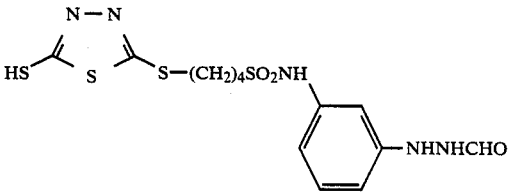
(I-19)
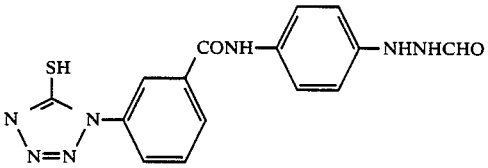
(I-20)
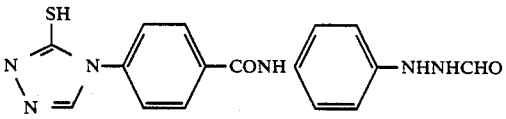

-continued
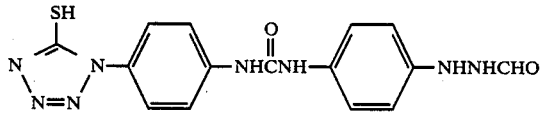
(I-21)
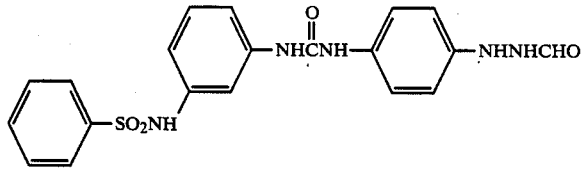
(I-22)
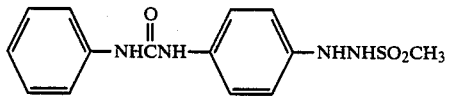
(I-23)
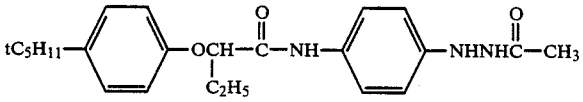
(I-24)
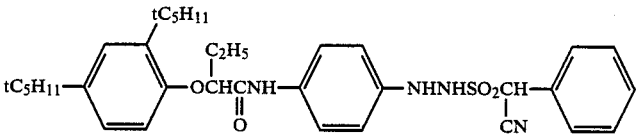
(I-25)
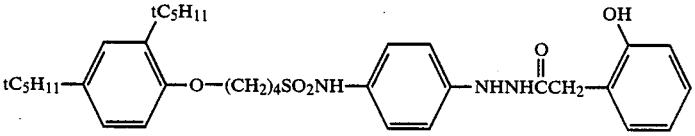
(I-26)
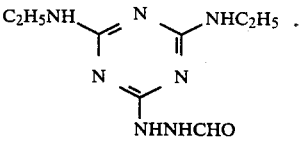
(I-27)
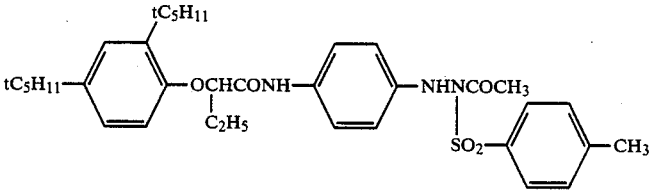
(I-28)
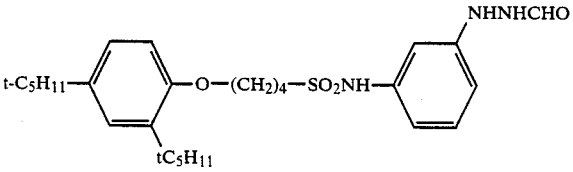
(I-29)
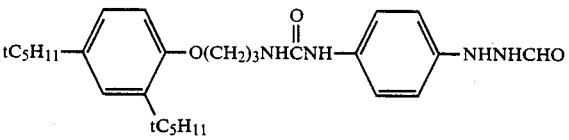
(I-30)

-continued (I-31)

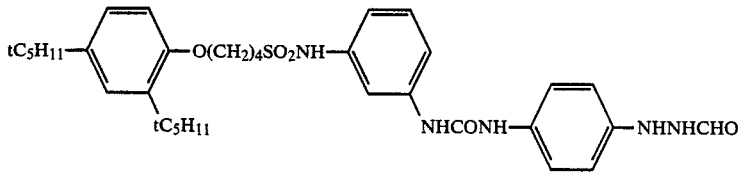

The halogen composition of the silver halide emulsion as coated on the photographic material to be processed by the method of the present invention is not specifically limited but may be selected from silver chloride, silver chlorobromide, silver bromide, silver iodobromide and other silver halides. The grain size and grain size distribution of the silver halide grains as well as the crystal habit thereof are not also specifically limited. In addition, there is no limitation as to whether or not the silver halide emulsions are chemically sensitized and so to what kind of sensitization method is to be applied to the emulsions when these are sensitized.

In the image formation method of the present invention, it is preferred to use a dihydroxybenzenetype developing agent as the main developing agent and to use a p-aminophenol-type developing agent or a 1-phenyl-3-pyrazolidone-type developing agent as an auxiliary developing agent.

The dihydroxybenzene-type developing agents for use in the present invention include, for example, hydroquinone, chlorohydroquinone, bromohydroquinone, isopropylhydroquinone, methylhydroquinone, 2,3-dichlorohydroquinone, 2,3-dibromohydroquinone and 2,5-dimethylhydroquinone; and hydroquinone is especially preferred among them.

As examples of 1-phenyl-3-pyrazolidone and derivatives thereof as an auxiliary developing agent, there are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone and 1-p-tolyl-4,4-dimethyl-3-pyrazolidone.

As examples of p-aminophenol-type auxiliary developing agents, there are N-methyl-p-aminophenol, p-aminiphenol, N-(β-hydroxyethyl)-p-aminophenol, N-(4-hydroxyphenyl)glycine, 2-methyl-p-aminophenol and p-benzylaminophenol; and N-methyl-p-aminophenol is most preferred among them.

The dihydroxybenzene-type developing agent is generally preferred to be used in an amount of from 0.05 mol/liter to 0.8 mol/liter. When a combination of a dihydroxybenzene compound and a 1-phenyl-3-pyrazolidone or p-aminophenol compound is used, it is preferred to use the former in an amount of from 0.05 mol/liter to 0.5 mol/liter and the latter in an amount of 0.06 mol/liter or less.

As examples of the sulfite preservative for use in the present invention, there are sodium sulfite, potassium sulfite, lithium sulfite, sodium bisulfite, potassium metabisulfite and formaldehyde-sodium bisulfite adduct. The sulfite is used in an amount of 0.15 mol/liter or more, but if the amount of the sulfite is too large, it would precipitate in the developer to stain the developer. Accordingly, the upper limit of the amount is preferably 1.2 mol/liter.

The developer for use in the present invention may contain a tertiary amine compound, especially the compound described in U.S. Pat. No. 4,269,929, as a development accelerator.

The developer for use in the present invention may also contain a pH buffer such as boric acid, borax, silicates, sodium tertiary phosphate or potassium tertiary phosphate, as well as the pH buffers described in JP-A-No. 60-93433. The concentration of the pH buffer to be incorporated into the developer is preferably 0.3 mol/liter or more. In addition, the developer may also contain a development inhibitor such as potassium bromide or potassium iodide; an organic solvent such as ethylene glycol, diethylene glycol, triethylene glycol, dimethylformamide, methyl cellosolve, hexylene glycol, ethanol or methanol; an antifoggant or a black pepper inhibitor such as indazole compounds (e.g., 5-nitroindazole), sodium 2-mercaptobenzimidazole-5-sulfonate or benzotriazole compounds (e.g., 5-methylbenzotriazole). The developer may further contain the amino compound described in U.S. Pat. No. 4,269,929.

Further, the developer may also contain a color toning agent, a surfactant, a water softener or a hardening agent, if desired. The pH value of the developer is preferably high to be pH 10.5 or more, especially preferably to fall within the range of from pH 10.5 to pH 12.3.

As a fixer, any conventional compositions can be used in the method of the present invention. As a fixing agent, thiosulfates and thiocyanates as well as other organic sulfur compounds which are known to have a function as a fixing agent can be used. The fixer may contain a water-soluble aluminum salt, such as aluminium sulfate or alum, as a hardening agent. The amount of the water-soluble aluminium salt to be incorporated into the fixer is generally up to 3.0 g/liter as Al. As an oxidizing agent, ethylenediamine-tetraacetic acid Fe(III) complex salt may be incorporated into the fixer.

The processing temperature is selected from the range of from 18° C. to 50° C., but it may be lower than 18° C. or may be higher than 50° C.

The following examples are intended to illustrate the present invention in greater detail but not to limit it in any way.

EXAMPLE 1

Preparation of Photographic Film (A)

An aqueous silver nitrate solution and an aqueous solution containing potassium iodide and potassium bromide were simultaneously added to an aqueous gelation solution as kept at 50° C., in the presence of potassium iridium (III) hexachloride in an amount of $4\times10^{-7}$ mol per mol of the silver and ammonia, over a period of 60 minutes, while the pAg value in the reaction system was kept to be 7.8. Thus a cubic monodispersed emulsion having a mean grain size of 0.25 μm and a mean silver iodide content of 0.1 mol % was prepared. This was desalted by flocculation method. Hypo was added to the emulsion and kept at 60° C. for chemical ripening.

5[3-(4-Sulfobutyl)-5-chloro-2-oxazolydilidene]-1-hydroxyethoxyethyl-3-(2-pyridyl)-2-thiohydantoin in an amount of $3\times10^{-4}$ mol per mol of silver, as a sensitizing dye, and the hydrazine derivative having the following structural formula in an amount of $3\times10^{-3}$ mol per mol of silver were added to said silver iodobromide emulsion. Further, 4-hydroxy-6-methyl-1,3,3a,7-tetrazaindene, hydroquinone, a dispersion of polyethylene glycol (molecular weight: 1000)-polyethyl acrylate, and 1,3-divinylsulfonyl-2-propanol were added thereto. The resulting emulsion was coated on a polyethylene terephthalate film in an amount of 3.4 g/m². The amount of gelatin coated was 2 g/m².

Hydrazine Derivative:

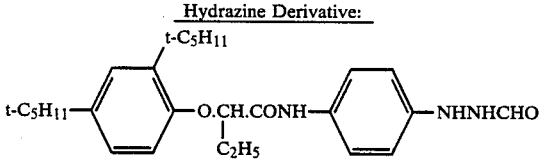

A protective layer containing 1.3 g/m² of gelatin, 50 mg/m² of polymethyl methacrylate having a grain size of 2.5 μm, 0.15 g/m² of methanol silica, the fluorine-containing surfactant having the following structural formula as a coating aid and sodium dodecylbenzenesulfonate was coated over the emulsion layer.

Surfactant:

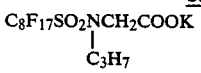

Preparation of Photographic Film (B)

The film (B) was prepared in a manner similar to the preparation of the film (A) with the following differences. Precisely, an aqueous silver nitrate solution and an aqueous solution containing potassium iodide and potassium bromide were simultaneously added to an aqueous gelatin solution as kept at 50° C., in the presence of potassium iridium(III) hexachloride in an amount of $4\times10^{-7}$ mol per mol of the silver and ammonia, over a period of 60 minutes, while the pAg value in the reaction system was kept to be 7.8. Thus a cubic monodispersed emulsion having a mean grain size of 0.28 μm and a mean silver iodide content of 0.4 mol % was prepared. This was desalted by flocculation method. An inactive gelatin was added thereto in an amount of 40 g per mol of silver. After the emulsion was kept at 50° C., 5,5'-dichloro-9-ethyl-3,3'-bis(3-sulfopropyl)oxacarbocyanine in an amount of $3\times10^{-4}$ mol per mol of silver, as a sensitizing dye, and a KI solution in an amount of 0.1 mol % per mol of silver were added thereto, and the resulting emulsion was kept at 50° C. for 15 minutes for re-dissolution. Hydroquinone (0.052 mol per mol of silver), the compound having the following structural formula (a) ($2\times10^{-4}$ mol per mol fo silver), the hydrazine derivative having the following structural formula (b) ($1.2\times10^{-3}$ mol per mol of silver) and the compound having the following structural formula (c) ($0.5\times10^{-4}$ mol per mol of silver) were added to the resulting solution.

(a)

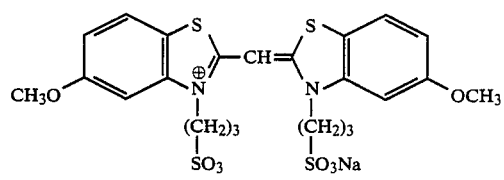

(b)

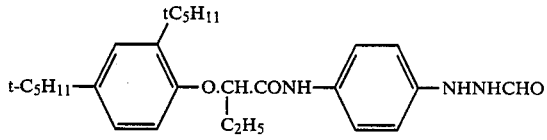

(c)

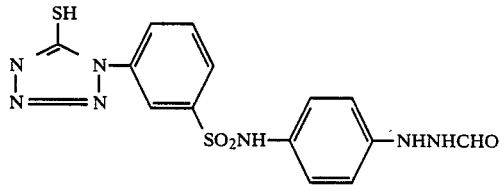

Further, 5-methylbenzotriazole, 4-hydroxy-1,3,3a,7-tetrazaindene, the following compounds (d) and (e), a dispersion of polyethyl acrylate and 1,3-divinylsulfonyl-2-propanol were added thereto. Then the resulting emulsion was coated on a polyethylene terephthalate film in an amount of 3.4 g/m² based on silver.

(d)

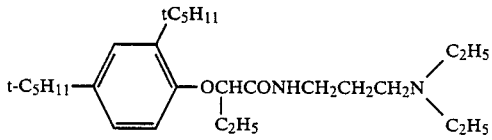

(e)

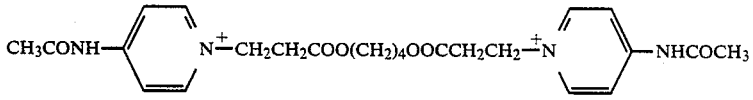

A protective layer comprising 1.5 g/cm² of gelatin, 50 g/m² of polyethyl methacrylate having a grain size of 2.5 μm, 0.15 g/m² of methanol silica, the fluorine-containing surfactant having the following structural formula as a coating aid and sodium dodecylbenzenesulfonate was coated over the emulsion layer.

Surfactant:

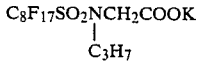

| Composition of Developer: | |
|---|---|
| Hydroquinone | 50.0 g |
| N-Methyl-p-aminophenol (½ Sulfate) | 0.3 g |
| Sodium hydroxide | 18.0 g |
| 5-Sulfosalicylic acid | 55.0 g |
| Potassium sulfite | 110.0 g |

-continued

| Composition of Developer: | |
|---|---|
| Sodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzene-sulfonate | 0.2 g |
| N-n-Butyldiethanolamine | 15.0 g |
| Sodium toluenesulfonate | 8.0 g |
| Boric acid | 10.0 g |
| Water to make | 1 liter |
| Sodium hydroxide to | pH of 11.6 |

Figure 1B:
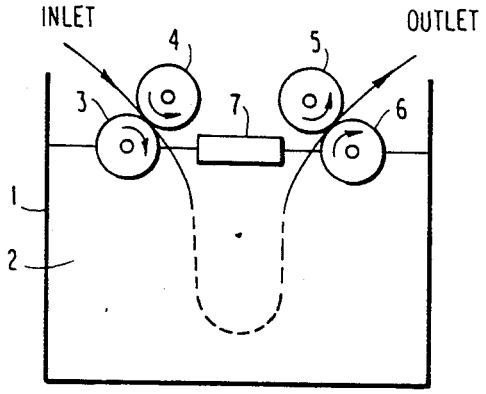
Figure 1C:
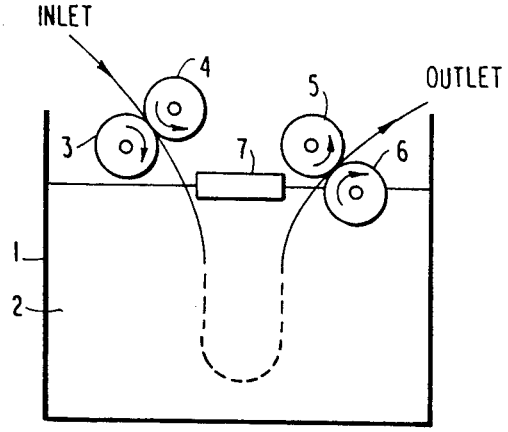

The hydrazine derivative-containing photographic film (A) was processed in a roller-conveying type automatic developing machine having the developer tank as shown in FIG. 1 (*c*), using the above-mentioned developer, under various conditions as indicated in Table 1 below. Then the variation of the pH value of the developer and the variation of the photographic propeties of the processed sample were investigated.

In the automatic developing machine used, the width of the developer tank (1) was 16.0 cm, the width of the floating lid (7) was 4.5 cm, the diameter of the roller (6) was 2.5 cm, the rotation speed of the rollers at the stand-by phase was 30 sec/one rotation, and the amount of the developer (2) was 12.3 liters. As a result, $K_S=0.021$ and $K_D=0.157$.

After the film was exposed, it was developed in the above-mentioned apparatus, whereupon the development temperature was 34° C., the development time was 35 seconds, the fixation temperature was 32° C., the fixation time was 30 seconds and the rinsing time was 30 seconds. The running condition of the automatic developing machine was to process 5 sheets/day of a full-large size sample (50.8 cm×61.0 cm) by 9-hour running a day. The amount of the replenisher for the developer was 2.6 liters/day.

The results obtained by the experiment were shown in Table 1, where ΔpH means a difference in the pH value between the fresh developer and the developer fatigued by the running procedure.

The sensitivity was represented by a relative logarithmic value of the reciprocal of the exposure for giving a density of 1.5 by development at 34° C. for 35 seconds, on the basis of the control value (100) of the corresponding sample as processed with a fresh developer.

In the case of Sample Nos. 2 to 4, the pH variation of the developer used obviously was small and the variation of the photographic properties was also suppressed. In the case of Sample No. 2, however, the developer somewhat deposited on the surface of the roller since the rotating time of the roller was too short. Accordingly, it is understood that stable processing is possible under the conditions for Sample Nos. 3 and 4, with no problem of staining.

In addition, in the case of the Sample Nos. 3 and 4, the variation of the activity of the developer was small and, therefore, the amount of the replenisher necessary to maintain the same developer activity as in the case of a conventional process was 2.3 liters.

EXAMPLE 2

The photographic film (B) was processed in the same manner as in Example 1, and the results were shown in Table 1 (Nos. 7 to 12). It is understood therefrom that stable processing is possible under the conditions for Sample Nos. 8 to 12 (embodiments of the present invention), with no problem of staining.

The amount of the replenisher necessary to maintain Sample Nos. 8 to 12 was also less, as in the case of Sample Nos. 3 and 4 of Example 1.

TABLE 1

| | | Periodical Running Condition of Roller at Stand-by phase | | Running Condition | | | | | | | | | | | |
|---|---|---|---|---|---|---|---|---|---|---|---|---|---|---|---|
| | | | | Fresh Developer | | | Normal atmosphere (25° C. 60% RH) 1 week | | | Summer Season (30° C., 70% RH) 1 week | | | High $CO_2$ (3000 ppm) 3 days | | |
| No. | Film Used | Rotation (min) | Stop (min) | ΔpH | Sensitivity | Dmax | ΔpH | Sensitivity | Dmax | ΔpH | Sensitivity | Dmax | ΔpH | Sensitivity | Dmax |
| 1 | A | Continuous | 0 | Type | 100 | 5.8 | 0.02 | 107 | 5.5 | 0.03 | 110 | 5.4 | −0.14 | 70 | 4.2 |
| 2 | " | 0.25 | 10.0 | " | " | " | 0.00 | 102 | 5.7 | 0.00 | 103 | 5.6 | −0.06 | 90 | 4.9 |
| 3 | " | 0.5 | 10.0 | " | " | " | 0.00 | 102 | 5.7 | 0.00 | 103 | 5.6 | −0.06 | 90 | 4.9 |
| 4 | " | 5.0 | 10.0 | " | " | " | 0.00 | 104 | 5.6 | 0.00 | 104 | 5.5 | −0.09 | 85 | 4.6 |
| 5 | " | 10.0 | 10.0 | " | " | " | 0.01 | 107 | 5.5 | 0.02 | 108 | 5.4 | −0.13 | 75 | 4.3 |
| 6 | " | 20.0 | 10.0 | " | " | " | 0.02 | 106 | 5.5 | 0.03 | 110 | 5.4 | −0.13 | 70 | 4.3 |
| 7 | B | Continuous | 0 | " | " | 5.2 | 0.02 | 105 | 4.9 | 0.03 | 107 | 4.9 | −0.14 | 80 | 4.4 |
| 8 | " | 0.25 | 10.0 | " | " | " | 0.00 | 101 | 5.1 | 0.00 | 102 | 5.1 | −0.06 | 92 | 4.9 |
| 9 | " | 0.5 | 10.0 | " | " | " | 0.00 | 101 | 5.1 | 0.00 | 102 | 5.1 | −0.06 | 92 | 4.9 |
| 10 | " | 5.0 | 10.0 | " | " | " | 0.01 | 102 | 5.0 | 0.01 | 104 | 5.0 | −0.09 | 89 | 4.7 |
| 11 | " | 10.0 | 10.0 | " | " | " | 0.02 | 105 | 5.0 | 0.02 | 106 | 5.0 | −0.13 | 82 | 4.5 |
| 12 | " | 20.0 | 10.0 | " | " | " | 0.02 | 104 | 5.0 | 0.03 | 107 | 5.0 | −0.13 | 80 | 4.5 |

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material having at least one silver halide emulsion layer on a support and containing at least one hydrazine derivative in said silver halide emulsion layer or in another hydrophilic colloid layer with a roller-conveying type automatic developig machine using a dihydroxybenzene developer containing a sulfite preservative in an amount of 0.15 mol/liter or more at a pH of 10.5 to 12.3, wherein any roller that is in contact with both the developer and air, among the rollers of said developing machine, is continuously rotated at a determined speed during conveyance or processing of the material during a processing phase, and intermittently rotated during a stand-by phase.

2. A method for processing a silver halide photographic material as in claim 1, in which the proportion of the time for rotating any roller which is in contact with both the developer and air at the stand-by phase to the total stand-by time is set to fall within the range of from ½ to 1/20.

3. A method for processing a silver halide photographic material as in claim 1, in which one period for rotating any roller which is in contact with both the developer and air at the stand-by phase is more than the time required for one rotation of said roller.

4. A method for processing a silver halide photographic material as in claim 1, in which the automatic developing machine has a developer tank having an open area ratio ($K_S$) of from 0.03 to 0.15 while the rollers are not moved, an open area ratio ($K_D$) of from 0.05 to 0.20 while the rollers are being moved, and a ratio of $K_D/K_S$ of from 1.2 to 5.

5. A method for processing a silver halide photographic material as in claim 1, in which the hydrazine derivative is selected from compounds of a general formula (I):

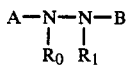

(I)

where A represents an aliphatic group or an aromatic group;

B represents a formyl group, an acyl group, an alkyl- or arylsulfonyl group, an alkyl- or arylsulfinyl group, a carbamoyl group, an alkoxy- or aryloxycarbonyl group, a sulfinamoyl group, an alkoxysulfonyl group, a thioacyl group, a thiocarbamoyl group, a sulfanyl group, or a heterocyclic group;

$R_0$ and $R_1$ are both hydrogen atoms, or one of them represents a hydrogen atom and the other represents a substituted or unsubstituted alkylsulfonyl group, a substituted or unsubstituted arylsulfonyl group, or a substituted or unsubstituted acyl group; and B and $R_1$ and the adjacent nitrogen atom to which B and $B_1$ are bonded may form a partial structure

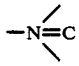

of a hydrazone.

6. A method for processing a silver halide photographic material as in claim 1, wherein the rollers are intermittently rotated during the stand-by phase at intervals and for such a period sufficiently to inhibit formation of deposits on the rollers.

7. A method for processing a silver halide photographic material as in claim 1, wherein the intermittent rotating is comprised of an on phase and off phase, and said off phase is not more than ten minutes.

* * * * *